US008544487B1

(12) United States Patent
Clinkscales

(10) Patent No.: US 8,544,487 B1
(45) Date of Patent: Oct. 1, 2013

(54) ACCESSORIZED CANE DEVICE

(76) Inventor: Sylvia Clinkscales, Hackensack, NJ (US)

( * ) Notice: Subject to any disclaimer, the term of this patent is extended or adjusted under 35 U.S.C. 154(b) by 296 days.

(21) Appl. No.: 13/170,508

(22) Filed: Jun. 28, 2011

(51) Int. Cl.
*A45B 9/04* (2006.01)
*A45B 3/02* (2006.01)
*A45B 3/00* (2006.01)

(52) U.S. Cl.
USPC ..... 135/75; 135/66; 135/77

(58) Field of Classification Search
USPC ..... 135/65, 66, 69, 75, 77
See application file for complete search history.

(56) References Cited

U.S. PATENT DOCUMENTS 3,987,807 A 10/1976 Varnell
4,253,479 A 3/1981 Laurent
5,482,070 A * 1/1996 Kelly ..... 135/66
5,699,819 A 12/1997 Simons
6,745,786 B1 * 6/2004 Davis ..... 135/65
6,772,778 B2 * 8/2004 Morosini et al. ..... 135/65
7,600,533 B2 * 10/2009 Tai et al. ..... 137/516.25
2007/0000531 A1 * 1/2007 Russo ..... 135/66
2009/0242008 A1 10/2009 Thibodeau et al.
2011/0271992 A1 * 11/2011 Senatro ..... 135/75

* cited by examiner

*Primary Examiner* — David Dunn
*Assistant Examiner* — Danielle Jackson

(57) ABSTRACT

The accessorized cane device provides advantages such as the focus on handle comfort. The lower rounded edges of the t-handle add to comfort, as does the t-handle itself. High density memory foam further adds to handle comfort, as does the finger slot. The sprung sliding action of the two sleeves contributes to comfort and function. The release mechanism may provide sprung use and un-sprung use. The spring loaded button is disposed conveniently within the bottom of the t-handle. The clock even provides an alarm and therefore offers further advantage. The light is especially useful, as placing a cane during walking in low light conditions can be extremely hazardous to a user. The stand provides for more secure standing for a user, and also for allowing the cane device to stand by itself.

4 Claims, 3 Drawing Sheets

ACCESSORIZED CANE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Canes, often called walking canes, are not only useful to many be required by some. Typical canes are not provided with features that might greatly enhance their usefulness. And, most cane grips are much too hard on hands. The present device provides several advantages over previously offered canes.

FIELD OF THE INVENTION

The accessorized cane device relates to walking canes.

SUMMARY OF THE INVENTION

The general purpose of the accessorized cane device, described subsequently in greater detail, is to provide an accessorized cane device which has many novel features that result in an improved accessorized cane device which is not anticipated, rendered obvious, suggested, or even implied by prior art, either alone or in combination thereof.

To attain this, the accessorized cane device provides accessories not heretofore provided in a cane. Among the advantages offered is the focus on handle comfort. The lower rounded edges of the t-handle add to comfort, as does the t-handle itself, as opposed to a handle extended only to one side of the shaft of a cane. While the handle cover may be comprised of various materials, relatively high density memory foam may be ideal. The finger slot offers further comfort. The sprung sliding action of the two sleeves contributes to comfort and function. The release mechanism may provide sprung use and un-sprung use. The spring loaded button may be disposed conveniently within the bottom of the t-handle. A more basic embodiment may only include a detent ball locking the inner sleeve from sliding within the outer sleeve. The clock even provides an alarm and therefore offers further advantage. The light is especially useful, as placing a cane during walking in low light conditions can be extremely hazardous to a user. A light sensor or a solar panel may be employed. The stand provides for more secure standing for a user, and also for allowing the cane device to stand by itself. While various means may be used to removably retain the stand immediately adjacent to the lower sleeve, magnets may be preferred.

Thus has been broadly outlined the more important features of the improved accessorized cane device so that the detailed description thereof that follows may be better understood and in order that the present contribution to the art may be better appreciated.

An object of the accessorized cane device is to provide a walking cane.

Another object of the accessorized cane device is to provide a walking cane with selectively operated spring assistance.

A further object of the accessorized cane device is to provide a cane with substantial focus on handle comfort.

An added object of the accessorized cane device is to provide a cane with a selectively deployed stand.

And, an object of the accessorized cane device is to provide a cane with an automatically operated light, triggered by low light conditions.

A further object of the accessorized cane device is to provide a clock.

These together with additional objects, features and advantages of the improved accessorized cane device will be readily apparent to those of ordinary skill in the art upon reading the following detailed description of presently preferred, but nonetheless illustrative, embodiments of the improved accessorized cane device when taken in conjunction with the accompanying drawings.

DETAILED DESCRIPTION OF THE DRAWINGS

With reference now to the drawings, and in particular FIGS. 1 through 6 thereof, the principles and concepts of the accessorized cane device generally designated by the reference number 10 will be described.

Figure 1:
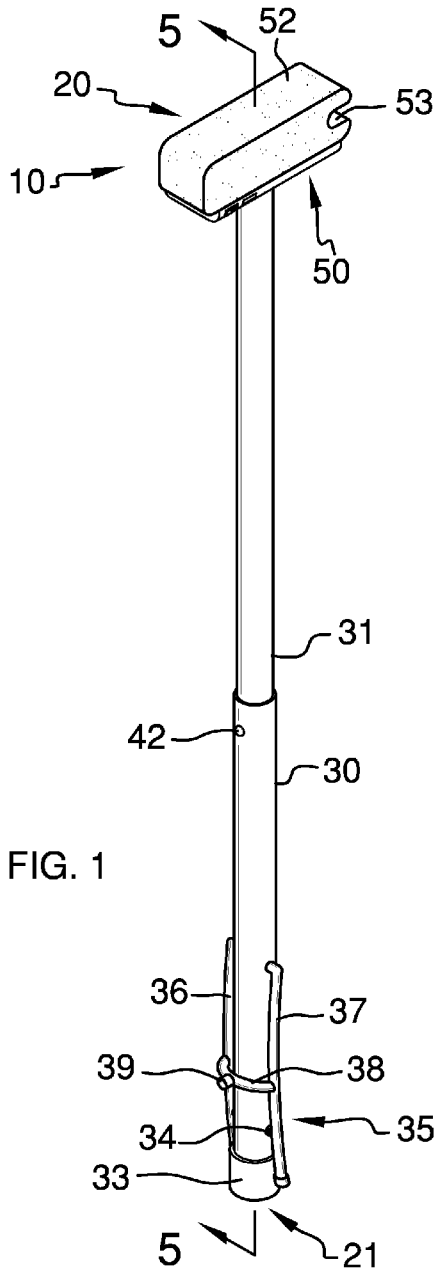
FIG. 1 is a perspective view.

Referring to FIG. 1, the device 10 partially comprises an upper end 20 spaced apart from a lower end 21.

Figure 5:
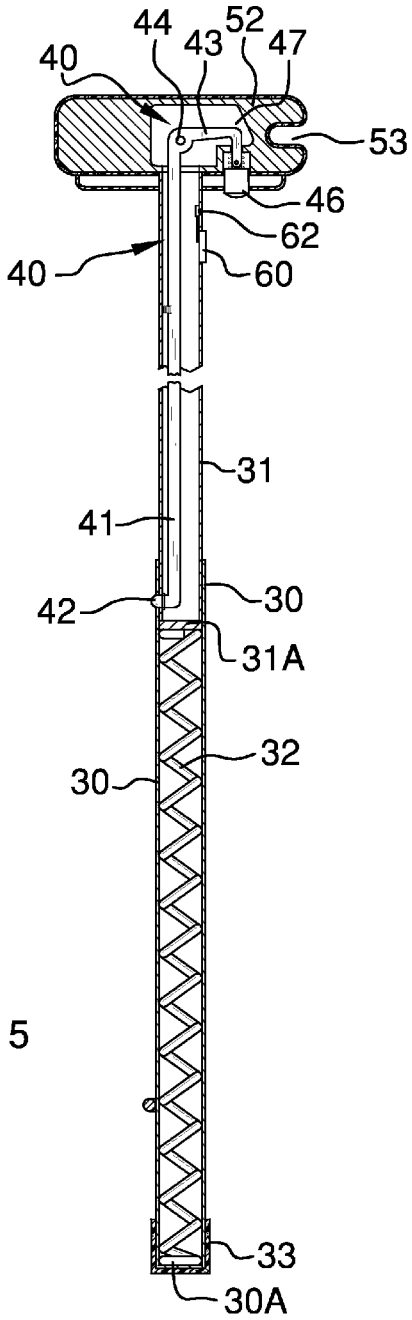
FIG. 5 is a cross sectional view of FIG. 1, taken along the line 5-5.

Referring to FIG. 5, the device 10 further comprises an outer sleeve 30 beginning at the lower end 21 and extended partially toward the upper end 20. The outer sleeve 30 has a bottom 30A. The inner sleeve 31 begins at the upper end 20 and is slideably inserted into the outer sleeve 30. The inner sleeve cap 31A is disposed downwardly on the inner sleeve 31. The compression spring 32 is disposed between the outer sleeve 30 bottom 30A and the inner sleeve cap 31A.

Figure 2:
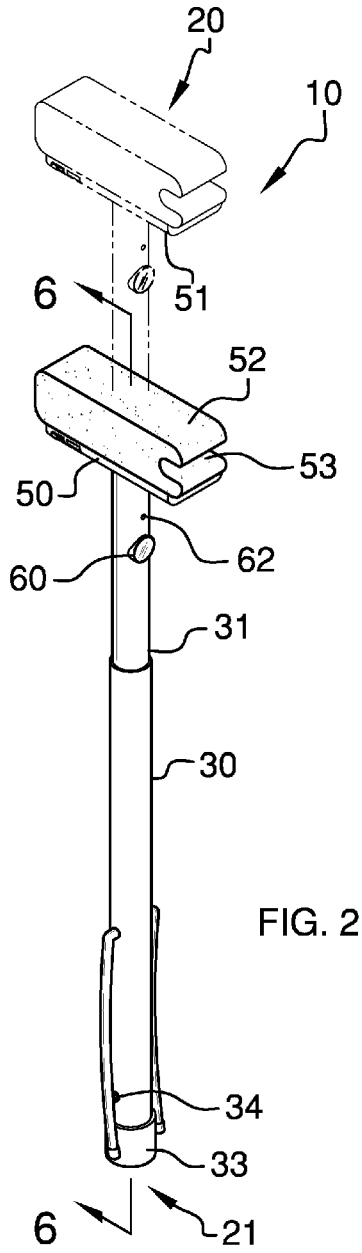
FIG. 2 is a perspective view illustrating spring interaction of the sleeves.

Referring to FIG. 2, the friction tip 33 is disposed on the lower end 21 on the outer sleeve 30.

Referring to FIGS. 1 and 2, the pair of diametrically opposed magnets 34 is disposed proximal to the lower end 21.

Figure 4:
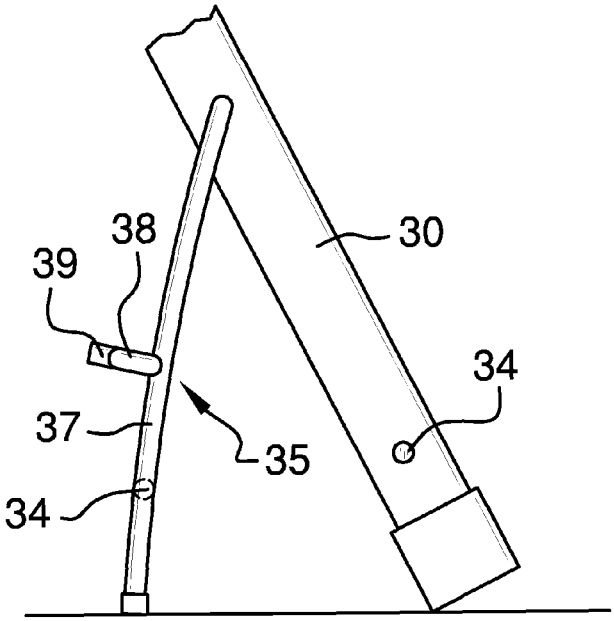
FIG. 4 is a lateral elevation view of the stand deployed.

Referring to FIG. 4 and FIG. 1, the stand 35 is pivotally disposed proximal to the lower end 21. The stand 35 comprises a curved first stand leg 36 spaced apart from a curved second stand leg 37 disposed pivotally and diametrically opposite on the outer sleeve 30. A magnet 34 is disposed inwardly on each leg. Each magnet 34 is attracted to one of the magnets 34 of the opposed magnets 34 of the lower end 21. The arc 38 joins the legs. The knob 39 is extended outwardly from the arc 38.

Figure 6:
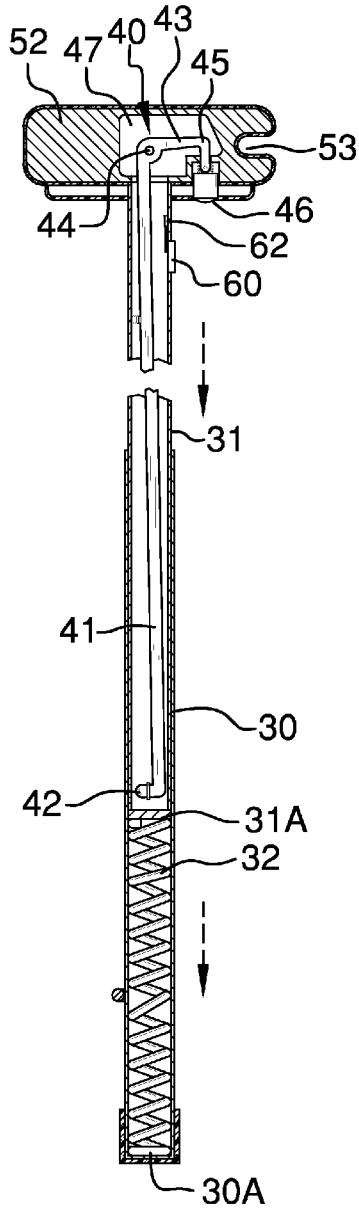
FIG. 6 is a cross sectional view of FIG. 2, taken along the line 6-6.

Referring to FIG. 5 and FIG. 6, the release mechanism 40 is disposed within the sleeves. The release mechanism 40 partially comprises the arm 41 extended from above the inner sleeve 31 into the outer sleeve 30.

Figure 3:
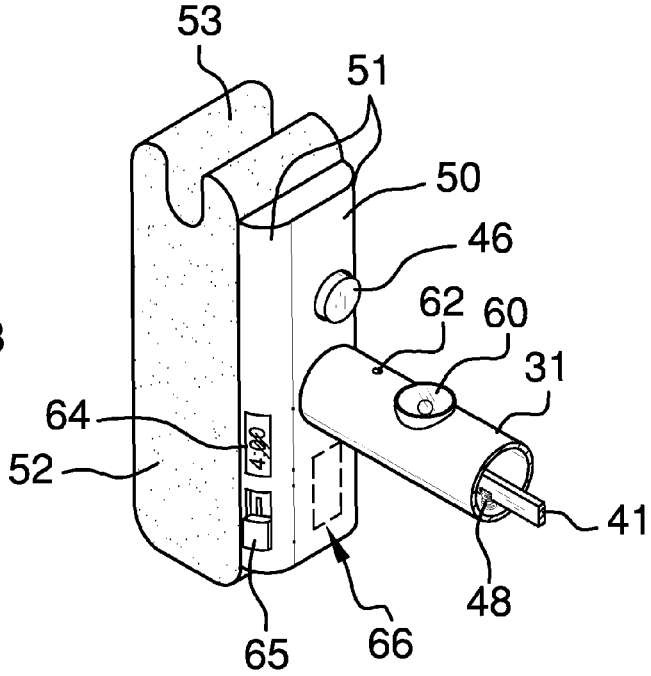
FIG. 3 is a perspective view of the handle bottom and a part of the upper sleeve.

Referring to FIG. 3, a return spring 48 is disposed between the arm 41 and the inner sleeve 31. The release pin 42 is disposed downwardly and perpendicularly on the arm 41. The release pin 42 is selectively positioned within the outer sleeve 30 in solidly positioning the inner sleeve 31 within the outer sleeve 30. The pivot 44 is disposed at the arm 41 upper end 20. The upper arm 43 is affixed perpendicularly to the arm 41 at the upper end 20. The downturn 45 is disposed distally on the upper arm 43. The spring loaded button 46 is disposed downwardly on the downturn 45. Depression of the spring loaded button 46 disengages the release pin 42 from the outer sleeve 30, thereby allowing the inner sleeve 31 to slide within the outer sleeve 30. The t-handle 50 is disposed atop the inner sleeve 31. The spring loaded button 46 is accessible downwardly within the t-handle 50. A pair of rounded edges 51 is disposed downwardly on the t-handle 50 and adds to t-handle 50 comfort for a user. The encasement 47 is disposed upwardly on the t-handle 50. The encasement 47 houses the pivot 44, the upper arm 43, and the downturn 45. The cover 52 is disposed atop the t-handle 50 and surrounds the encasement 47.

Referring to FIG. 3, a finger slot 53 is disposed within one end of the cover 52. The light 60 is disposed within the inner sleeve 31 proximal to the upper end 20. The sensor 62 is disposed within the inner sleeve 31 proximal to the light 60. The sensor 62 controls the light 60 by switching the light 60 on in low light conditions thereby lighting the way for a user and therein avoiding accidents. The clock 64 is disposed within the t-handle 50. A control 65 is disposed within the t-handle 50. The control 65 is in communication with the clock 64. The battery 66 is disposed within the t-handle 50. The battery 66 is in communication with the sensor 62, the clock 64, and the control 65.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the accessorized cane device may be used.

What is claimed is:

1. An accessorized cane device comprising, in combination:

an upper end spaced apart from a lower end;

an outer sleeve beginning at the lower end and extended partially toward the upper end, the outer sleeve having a bottom;

an inner sleeve beginning at the upper end and slideably inserted into the outer sleeve;

an inner sleeve cap disposed downwardly on the inner sleeve;

a compression spring disposed between the outer sleeve bottom and the inner sleeve cap;

a friction tip disposed on the lower end on the outer sleeve;

a release mechanism disposed within the sleeves, the release mechanism comprising:

an arm extended from above the inner sleeve into the outer sleeve;

a return spring disposed between the arm and the inner sleeve;

a release pin disposed downwardly and perpendicularly on the arm, the release pin selectively positioned within the outer sleeve in solidly positioning the inner sleeve within the outer sleeve;

a pivot disposed at the arm upper end;

an upper arm affixed perpendicularly to the arm at the upper end;

a downturn disposed distally on the upper arm;

a spring loaded button disposed downwardly on the downturn;

whereby a depression of the spring loaded button disengages the release pin from the outer sleeve, thereby allowing the inner sleeve to slide within the outer sleeve;

a t-handle disposed atop the inner sleeve, the spring loaded button accessible downwardly within the t-handle;

a pair of rounded edges disposed downwardly on the t-handle;

an encasement disposed upwardly on the t-handle, the encasement housing the pivot, the upper arm, and the downturn;

a cover disposed atop the t-handle and surrounding the encasement;

a finger slot disposed within one end of the cover;

a light disposed within the inner sleeve proximal to the upper end;

a sensor disposed within the inner sleeve proximal to the light, the sensor controlling the light;

a clock disposed within the t-handle;

a control disposed within the t-handle, the control in communication with the clock;

a battery disposed within the t-handle, the battery in communication with the sensor, the clock, and the control.

2. The device according to claim 1 wherein the cover further comprises a memory foam.

3. An accessorized cane device comprising, in combination:

an upper end spaced apart from a lower end;

an outer sleeve beginning at the lower end and extended partially toward the upper end, the outer sleeve having a bottom;

an inner sleeve beginning at the upper end and slideably inserted into the outer sleeve;

an inner sleeve cap disposed downwardly on the inner sleeve;

a compression spring disposed between the outer sleeve bottom and the inner sleeve cap;

a friction tip disposed on the lower end on the outer sleeve;

a pair of diametrically opposed magnets disposed proximal to the lower end;

a stand pivotally disposed proximal to the lower end, the stand comprising:

a curved first stand leg spaced apart from a curved second stand leg disposed pivotally and diametrically opposite on the outer sleeve;

a magnet disposed inwardly on each leg, each magnet attracted to one magnet of the opposed magnets of the lower end;

an arc joining the legs;

a knob extended outwardly from the arc;

a release mechanism disposed within the sleeves, the release mechanism comprising:

an arm extended from above the inner sleeve into the outer sleeve;

a return spring disposed between the arm and the inner sleeve;

a release pin disposed downwardly and perpendicularly on the arm, the release pin selectively positioned within the outer sleeve in solidly positioning the inner sleeve within the outer sleeve;

a pivot disposed at the arm upper end;

an upper arm affixed perpendicularly to the arm at the upper end;

a downturn disposed distally on the upper arm;

a spring loaded button disposed downwardly on the downturn;

whereby a depression of the spring loaded button disengages the release pin from the outer sleeve, thereby allowing the inner sleeve to slide within the outer sleeve;

a t-handle disposed atop the inner sleeve, the spring loaded button accessible downwardly within the t-handle;

a pair of rounded edges disposed downwardly on the t-handle;

an encasement disposed upwardly on the t-handle, the encasement housing the pivot, the upper arm, and the downturn;

a cover disposed atop the t-handle and surrounding the encasement;

a finger slot disposed within one end of the cover;

a light disposed within the inner sleeve proximal to the upper end;

a sensor disposed within the inner sleeve proximal to the light, the sensor controlling the light;

a clock disposed within the t-handle;

a control disposed within the t-handle, the control in communication with the clock;

a battery disposed within the t-handle, the battery in communication with the sensor, the clock, and the control.

4. The device according to claim 3 wherein the cover further comprises a memory foam.

* * * * *